US005176500A

United States Patent [19]

Heinig

[11] Patent Number: 5,176,500

[45] Date of Patent: Jan. 5, 1993

[54] TWO-LUG SIDE-ENTRY TURBINE BLADE ATTACHMENT

[75] Inventor: Roger W. Heinig, Cocoa Beach, Fla.

[73] Assignee: Westinghouse Electric Corp., Pittsburgh, Pa.

[21] Appl. No.: 856,997

[22] Filed: Mar. 24, 1992

[51] Int. Cl.[5] ..... B21K 3/04

[52] U.S. Cl. ..... 416/219 R

[58] Field of Search ..... 416/219 R, 223 A, 248, 416/500

[56] References Cited

U.S. PATENT DOCUMENTS

| | | | |
|---|---|---|---|
| 4,191,509 | 3/1980 | Leonardi | 416/219 R |
| 4,260,331 | 4/1981 | Goodwin | 416/219 R |
| 5,110,262 | 5/1992 | Evans | 416/219 R |

*Primary Examiner*—John T. Kwon

[57] ABSTRACT

A blade root including, in downward order and symmetrical on each side of a center line: an upper neck of width $w_2$; an upper lug having an upper flat bearing surface and a fillet surface of radius $R_2$, the upper root bearing surface contacting an upper flat groove bearing surface, the groove including a fillet surface of radius $R_3$, the upper root bearing surface and the upper groove bearing surface contacting over a length $l_1$ from the beginning point of the upper groove bearing surface to the terminating point of the upper root bearing surface; a lower neck of width $w_2$; and a lower lug having a lower flat root bearing surface and a fillet surface of radius $R_6$, the lower root bearing surface contacting a lower flat groove bearing surface, the groove including a fillet surface of radius $r_7$, the lower root bearing surface and the lower groove bearing surface contacting over a length $l_2$, with the following ratios, $w_2$ to $w_1$ about 0.69, $R_2$ to $w_1$ about 0.15, $R_3$ to $w_1$ about 0.15, $R_6$ to $w_1$ about 0.08, $R_7$ to $w_1$ about 0.12, $l_1$ to $w_1$ about 0.13, and $l_2$ to $w_1$ about 0.10.

5 Claims, 3 Drawing Sheets

TWO-LUG SIDE-ENTRY TURBINE BLADE ATTACHMENT

BACKGROUND OF THE INVENTION

1. Field of the Invention

The present invention relates generally to steam turbine blades and, more specifically, to a two-lug side-entry turbine blade attachment for use with relatively small blades which are assembled into milled grooves.

2. Description of the Related Art

Turbine blades may be attached to turbine rotors in a variety of ways. One well known structure is the use of a "fir-tree" side-entry root. The root configuration derives its name from the fact that it employs at least two lugs which generally increase in size from lowermost to uppermost.

The basic fir-tree root configuration contains multiple potential load paths, with the magnitude of the resulting stresses therein dependent upon the precision of the initial fit between the root and its corresponding groove. These stresses are of particular concern for such potential failure mechanisms as high-cycle fatigue, low-cycle fatigue and stress corrosion cracking.

Blades with fir-tree roots are characteristically susceptible to important vibratory modes in which the neutral axis of vibration in the root is approximately parallel to the axis of the turbine rotor. For such vibratory behavior, the uppermost lands of a fir-tree root provide a large portion of the total root stiffness and load-carrying ability. For that reason, it is particularly important that these uppermost lands be in firm contact during turbine operation. Manufacturing tolerances must be selected so as to ensure that this firm contact occurs on the uppermost lands, while at the same time minimizing the peak stresses throughout the blade fastening structure.

To accomplish these ends, fir-tree roots are often designed with median tolerance dimensions which provide a very small clearance on the lower lands when the turbine is at standstill. The magnitude of this median lower land clearance is a function of the tolerances themselves. For a given fir-tree root design and application, larger tolerances require a larger median lower land clearance to ensure that the uppermost lands are in firm contact during turbine operation.

Certain characteristics tend to increase the magnitude of manufacturing tolerance deviations. One such characteristic is the use of different rotor diameters, root designs or number of blades per row in closely adjoining rows. Any of these features precludes the use of broaching as a groove manufacturing method and requires instead that intrinsically less precise milling machine methods be used. A related characteristic is the width of the lower lugs. Increased width raises the loads upon the milling cutter, thus decreasing the precision of its cutting path.

Certain characteristics of the blade, root, and groove also tend to increase the dimensional influence of manufacturing tolerance deviations. These include small absolute size, and relatively low applied steady loading.

Certain characteristics of the blade tend to increase the likelihood of adverse consequences due to imprecise fit of the root in its corresponding groove. One important such characteristic is a design in which the lowermost modes of vibration are untuned, in that they are permitted to be in resonance. Low modes tend to produce the largest high-cycle fatigue stresses in the root rather than elsewhere in the blade. Untuned blades are in general small in size relative to other blades in the same turbine.

Determining root and groove profiles with acceptable maximum and minimum clearances is extremely difficult, keeping in mind that zero clearance (surface to surface contact) must occur precisely at the lug or steeple lands when the centrifugal load is applied. For a two-lug side-entry turbine blade there are only two lands corresponding to the two lugs (there would be left and right lands disposed on opposite sides of the root center line, which is also the plane of symmetry, thus making a total of four lands, two at each lug).

Thus, a great deal of time and effort goes into designing each blade attachment for a steam turbine or combustion turbine. An example of prior art methods of designing side entry turbine blade roots is shown in U.S. Pat. No. 4,692,976, issued to Andrews. In that patent, a method is provided for producing a scalable two-lug (or tang) side-entry turbine blade with significantly reduced stress concentration attributable to centrifugal and bending loads on the blade root. The design incorporated therein equalizes the stresses at all points of stress concentration. As a result of the degree of precision which is required in the creation of the blade attachment, the surfaces of the blade root and groove are defined in terms of the lengths of their respective radii, the location of the pivot centers for the respective radii, the beginning and terminating points of each curved segment, and the length of the lands (or flats) associated with each of the two lugs.

In U.S. Pat. No. 4,824,328, issued to Pisz et al., another turbine blade attachment is disclosed in which the blade root and groove profiles are defined in terms of specific relationships.

A continuing need exists for a turbine blade attachment which reduces the magnitude of manufacturing tolerance deviations when the groove manufacture must be accomplished by milling. Also, a continuing need exists for turbine blade attachment which reduces the adverse consequences of manufacturing tolerance deviations, particularly with respect to high cycle fatigue and stress corrosion cracking.

SUMMARY OF THE INVENTION

An object of the present invention is therefore to provide a two-lug, side-entry turbine blade attachment having improved manufacturability when milling is used to form the groove, so that the magnitude of expected tolerance deviations is reduced.

Another object of the present invention is to provide a two-lug side-entry turbine blade attachment having less sensitivity to root and groove manufacturing tolerance deviations, as well as less sensitivity to blade radial position assembly tolerances and significantly lower steeple or lug stresses under all fit conditions.

These and other objects of the invention are met by providing a root for attaching a blade to a rotor in a groove having a shape substantially corresponding to a shape of the root, such that the root and groove have a common center line, the root including an uppermost neck of width $w_1$ symmetrically shaped about the root center line, an uppermost lug formed below the uppermost neck and symmetrically shaped about the root center line and having on each side of the center line an uppermost flat root bearing surface which is defined by a beginning point and a terminating point, the terminating point being at a greater horizontal distance from the root center line than the beginning point, and a radiused fillet surface of radius R2, an arcuate length of which is defined by a terminating point coexistent with the beginning point of the uppermost root bearing surface, the uppermost root bearing surface being in surface contact with a corresponding uppermost flat groove bearing surface which is defined by a beginning point and a terminating point, the terminating point being at a greater horizontal distance from the groove center line than the beginning point, the groove including a radiused fillet surface of radius R3, an arcuate length of which is defined by a beginning point coexistent with the terminating point of the uppermost groove bearing surface, a zone of contact between the uppermost root bearing surface and the uppermost groove bearing surface extending over a length $l_1$ from the beginning point of the uppermost groove bearing surface to the terminating point of the uppermost root bearing surface, the root also including a lowermost neck of width $w_2$ formed below the uppermost lug and symmetrically shaped about the center line, and a lowermost lug formed below the lowermost neck symmetrically shaped about the root center line and having on each side of the center line a lowermost flat root bearing surface which is defined by a beginning point and a terminating point, the terminating point being at a greater horizontal distance from the root center line than the beginning point, and a radiused fillet surface of radius R6, an arcuate length of which is defined by a terminating point coexistent with the beginning point of the lowermost root bearing surface, the lowermost root bearing surface being in surface contact with a corresponding lowermost flat groove bearing surface which is defined by a beginning point and a terminating point, the terminating point being at a greater horizontal distance from the groove center line than the beginning point, the groove including a radiused fillet surface of radius R7, an arcuate length of which is defined by a beginning point coexistent with the terminating point of the lowermost groove bearing surface, a zone of contact between the lowermost root bearing surface and the lowermost groove bearing surface extending over a length $l_2$ from the beginning point of the lowermost groove bearing surface to the terminating point of the lowermost root bearing surface, wherein a ratio of $w_2$ to $w_1$ is about 0.69, a ratio of R2 to $w_1$ is about 0.15, a ratio of R3 to w is about 0.15, a ratio of R6 to $w_1$ is about 0.08, a ratio of R7 to $w_1$ is about 0.12, a ratio of $l_1$ to $w_1$ is about 0.13, and a ratio of $l_2$ to $w_1$ is about 0.10.

These and other objects and advantages of the present invention will become more apparent with reference to the following detailed description and drawings.

DETAILED DESCRIPTION OF THE PREFERRED EMBODIMENTS

Figure 1:
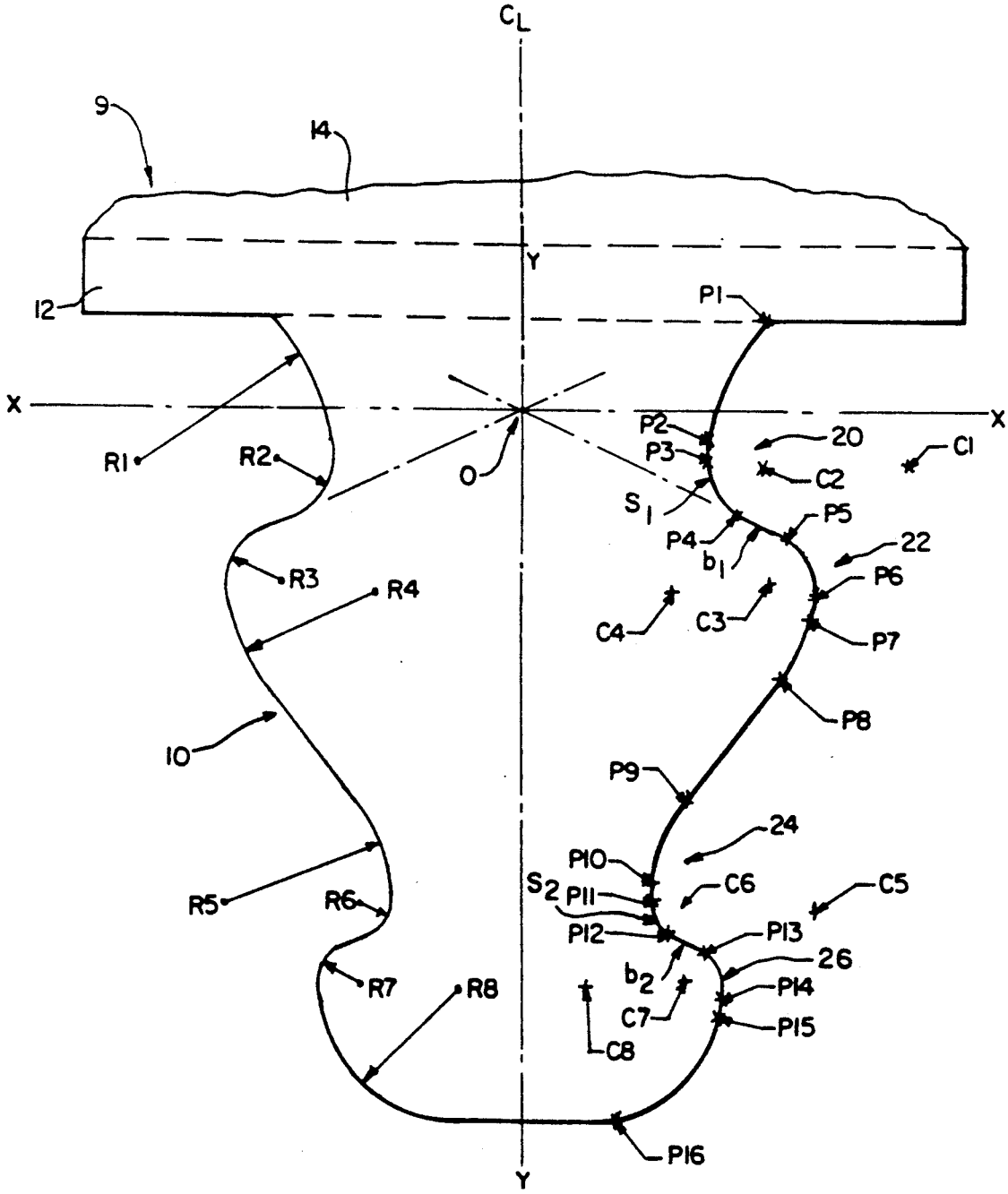
FIG. 1 is a side view illustrating a contour of a root portion of a turbine blade according to the present invention.
Figure 2:
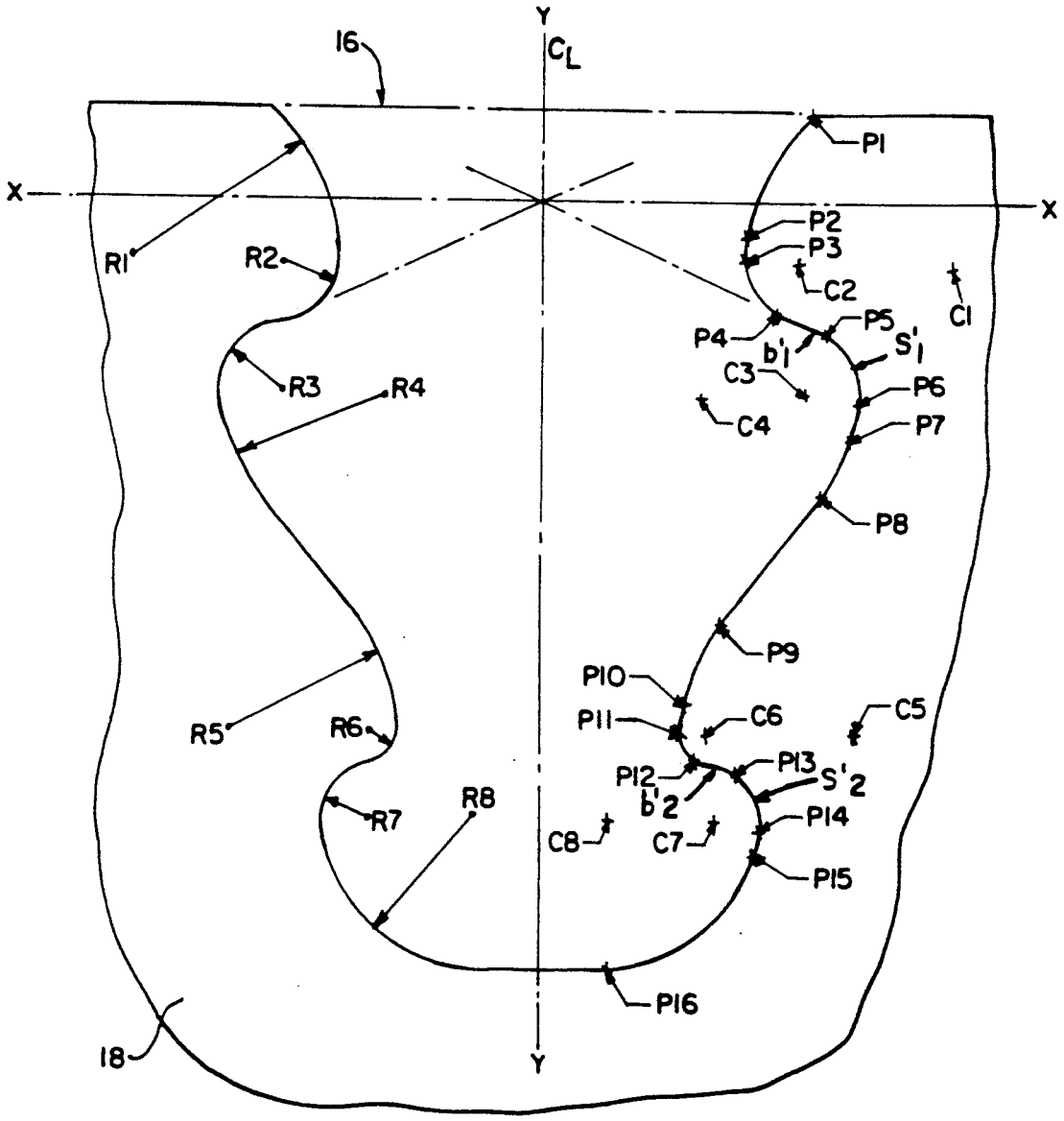
FIG. 2 is a side view showing a contour of a groove into which the root of FIG. 1 is interfitted.
Figure 3:
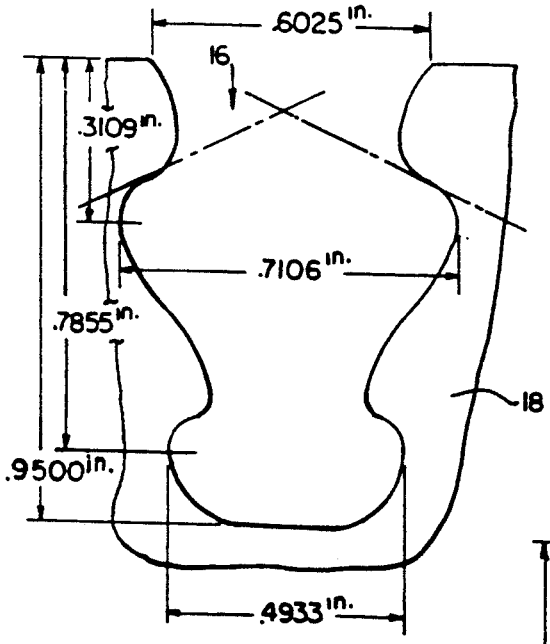
FIG. 3 is another side view of the groove of FIG. 2.

Referring now to the figures, a turbine blade 9 includes a root portion 10 which extends downwardly from a platform portion 12, and a foil portion 14 extends upwardly from the platform portion 12. The foil portion 14 has been substantially cut away since the focus of the present invention is the root portion 10. The root portion profile is illustrated in FIG. 1, with the profile corresponding substantially to that of the corresponding groove 16, illustrated in FIG. 2, which is a side-entry groove formed in a rotor 18 of a turbine.

Referring back to FIG. 1, the root portion 10 has an uppermost neck 20 which extends downwardly from the platform portion 12, an uppermost lug 22 which extends downwardly from the uppermost neck, a lowermost neck 24 extending downwardly from the uppermost lug 22, and a lowermost lug 26 extending downwardly from the lowermost neck 24.

The profile of the root portion 10 is defined by a coordinate-point system, which locates points P1–P16 on the surface of the root portion 10. The surface is identical on both sides of the root center line CL so that points P1–P16 would be identical for the left-hand side of the root portion, except for the signs of the coordinate points.

For arcuate segments of the surface, radii R1–R8 are used to construct the arcuate surfaces. Each radius R1–R8 has a respective pivot center C1–C8 from which the radius extends to the surface. The following chart details in coordinate point fashion the locations of points P1–P16, and the pivot centers C1–C8, as well as the dimensions or lengths of the radii R1–R8 (although the dimensions for the radii in the chart represent the preferred embodiment of the present invention in which the lengths are in inches, practicing the present invention could employ scaled versions of the dimensions):

| ROOT DIMENSIONS | | | | | | | |
|---|---|---|---|---|---|---|---|
| | | | RADIUS DEFINITION | | | | |
| POINT | X | Y | Radius | DIM | CENTER | X | Y |
| P1 | .30028914 | +.10880000 | R1 | .2375 | C1 | .46247420 | −.06469995 |
| P2 | .22700906 | −.03367714 | | | | | |
| P3 | .22432500 | −.05404933 | R2 | .0655 | C2 | .28926380 | −.06260509 |
| P4 | .26158409 | −.12196909 | | | | | |
| P5 | .31579521 | −.14724616 | R3 | .0617 | C3 | .28972134 | −.20316613 |
| P6 | .34985551 | −.21697817 | | | | | |
| P7 | .34177111 | −.25217557 | R4 | .1697 | C4 | .17637779 | −.21418688 |
| P8 | .31085514 | −.31769501 | | | | | |
| P9 | .19697976 | −.46564145 | R5 | .1979 | C5 | .35380396 | −.58635010 |
| P10 | .15759953 | −.56049994 | | | | | |
| P11 | .15503058 | −.57999842 | R6 | .0341 | C6 | .18883842 | −.58445265 |
| P12 | .17442806 | −.61535818 | | | | | |
| P13 | .21519182 | −.63436514 | R7 | .0478 | C7 | .19499197 | −.67768726 |

-continued

| ROOT DIMENSIONS | | | | | | | |
|---|---|---|---|---|---|---|---|
| | | | RADIUS DEFINITION | | | | |
| POINT | X | Y | Radius | DIM | CENTER | X | Y |
| P14 | .24157890 | −.68838766 | | | | | |
| P15 | .23476727 | −.71804376 | R8 | .1625 | C8 | .07639123 | −.68166685 |
| P16 | .11639122 | −.83916685 | | | | | |

The uppermost neck 20 has a width $w_1$ (FIG. 4) which is defined by twice the subtraction of radius R2 from the X-coordinate of center point C2.

The uppermost lug 22 is formed symmetrically about the root center line CL and has on each side of the center line CL a flat bearing surface $b_1$, a length of which is defined by a beginning point P4 and a terminating point P5. The terminating point P5 is at a greater horizontal distance from the root center line CL than the beginning point P4. The bearing surface b1 is in surface contact with a corresponding flat bearing surface $b_1'$ of the groove 16 (see FIG. 2, points P4 and P5), over a length $l_1$, which extends from point P4 of the groove to point P5 of the root.

A radiused root fillet surface $s_1$ is defined by the beginning point P3 and the terminating point P4 of the root, the terminating point P4 being coexistent with the beginning point P4 of the root bearing surface $b_1$. The radiused root fillet surface s is defined by a radius R2 of the root, which is drawn from a pivot center C2 of the root.

A radiused groove fillet surface $s_1'$ is defined by the beginning point P5 and the terminating point P6 of the groove, the beginning point P5 being coexistent with the terminating point P5 of the groove flat bearing surface $b_1'$. The radiused groove fillet surface $S_1'$ is defined by a radius R3 of the groove, which is drawn from a pivot center C3 of the groove.

Similarly, the lowermost neck 24 has a width $w_2$ (FIG. 4) which is defined by twice the subtraction of radius R6 of the root from the X-coordinate of center point C6 of the root.

The lowermost lug 26 is formed symmetrically about the root center line CL and has on each side of the center line a flat bearing surface $b_2$, a length of which is defined by a beginning point P12 and a terminating point P13. The terminating point P13 is at a greater horizontal distance from the root center line CL than the beginning point P12. The bearing surface $b_2$ is in surface contact with a corresponding flat bearing surface $b_2'$ of the groove 16 (see FIG. 2, points P12 and P13), over a length $l_2$, which extends from point P12 of the groove to point P13 of the root.

A radiused root fillet surface $s_2$ is defined by the beginning point P11 and the terminating point P12 of the root, the terminating point P12 being coexistent with the beginning point P12 of the flat root bearing surface $b_2$. The radiused root fillet surface $s_2$ is defined by a radius R6 of the root, which is drawn from a pivot center C6 of the root.

A radiused groove fillet surface $s_2'$ is defined by the beginning point P13 and the terminating point P14 of the groove, the beginning point P13 being coexistent with the terminating point P13 of the groove flat bearing surface $b_2'$. The radiused groove fillet surface $s_2'$ is defined by a radius R7 of the groove, which is drawn from a pivot center C7 of the groove.

All of the dimensions described in the preceding paragraph are nominal dimensions which approximate the maximum material conditions for the root and for the groove. Manufacturing tolerances are assigned so as to establish a median clearance of 0.00065 inches between the flat bearing surface $b_2$ of the root and the corresponding flat bearing surface $b_2'$ of the groove, when the rotor is at isothermal standstill conditions.

According to the present invention, the width $w_2$ of the groove lowermost neck 24 has been increased at the expense of the radius R7 and the contact length $l_2$ so as to increase the stiffness of the groove milling cutter, and thus to improve control of the critical dimensional relationship between the positions of the groove contact surfaces. Moreover, the radius R3 has been increased so as to reduce the peak stresses which exist in the rotor in the vicinity of the groove under conditions of less-than-perfect fit. The relative dimensions can be expressed in terms of ratios, whereby a ratio of $w_2$ to $w_1$ is about 0.69, a ratio of root R2 to $w_1$ is about 0.15, a ratio of groove R3 to $w_1$ is about 0.15, a ratio of root R6 to $w_1$ is about 0.08, a ratio of groove R7 to $w_1$ is about 0.12, a ratio of $l_1$ to $w_1$ is about 0.13, and a ratio of $l_2$ to $w_1$ is about 0.10.

Both of the flat bearing surfaces $b_1$ and $b_2$ are at 25° to a transverse plane. Moreover, in determining the coordinate system for quantifying the reference points in FIGS. 1 and 2, the root center line CL also forms the Y axis, while the X axis is determined by the intersection of the flat bearing surfaces $b_1$ with the Y axis. As shown in FIG. 1, planes which include the upper flat bearing surfaces $b_1$ intersect the Y axis at a point 0 and a line drawn perpendicular to the Y axis at that point provides the X axis.

Figure 4:
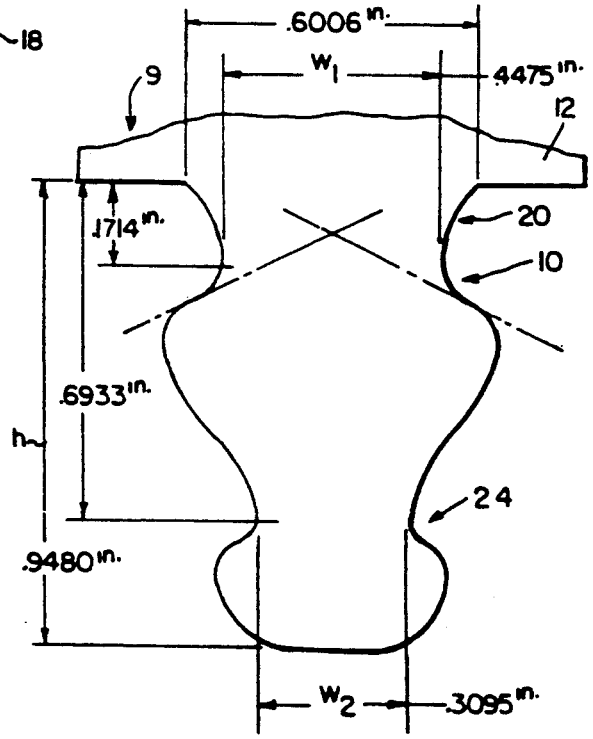
FIG. 4 is another side view of the root portion shown in FIG. 1, illustrating root dimensions.

FIG. 4 shows relative dimensions of the root portion 10. A ratio of the uppermost neck 20 width $w_1$ and the lowermost neck 24 width $w_2$ preferably is about 0.69. Moreover, the root 10 has a height h which is preferably about 0.948 inches (24.08 millimeters). The width $w_2$ is about 0.3095 inches (7.861 millimeters) and $w_1$ is about 0.4475 inches (11.367 millimeters). A ratio of $w_2$ to h is about 0.33 and a ratio of $w_1$ to h is about 0.47. Relationships between various portions of the corresponding groove are about the same, due to the close tolerances between the two.

Figure 5:
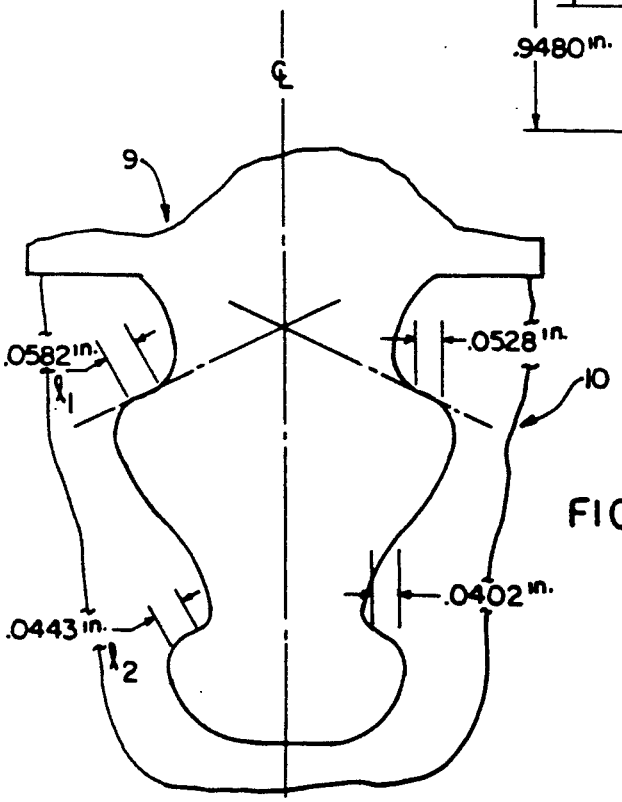
FIG. 5 is a side view showing nominal root to groove bearing surface contact.

The lengths or zones of contact $l_1$ and $l_2$ between the bearing surfaces $b_1$ and $b_1'$ and $b_2$ and $b_2'$, respectively, are measured parallel to the bearing surfaces, as shown in FIG. 5. FIG. 5 illustrates the root interfitted into the groove, and as shown in the following table, the dimensions of the groove are very close to the dimensions of the root:

| GROOVE DIMENSIONS | | | | | | | |
|---|---|---|---|---|---|---|---|
| | | | RADIUS DEFINITION | | | | |
| POINT | X | Y | Radius | DIM | CENTER | X | Y |
| P1 | .30122907 | +.10280000 | R1 | .2325 | C1 | .46247420 | −.06469995 |
| P2 | .23196622 | −.03433025 | | | | | |
| P3 | .22859738 | −.05989996 | R2 | .0605 | C2 | .28857903 | −.06780261 |
| P4 | .26301227 | −.12263500 | | | | | |
| P5 | .31676360 | −.14769769 | R3 | .0667 | C3 | .28857678 | −.20814927 |
| P6 | .35358406 | −.22308059 | | | | | |
| P7 | .34664422 | −.25329486 | R4 | .1747 | C4 | .17637779 | −.21418688 |
| P8 | .31481735 | −.32074475 | | | | | |
| P9 | .19987712 | −.47007463 | R5 | .1929 | C5 | .35273912 | −.58773354 |
| P10 | .16149185 | −.56253649 | | | | | |
| P11 | .15847147 | −.58546135 | R6 | .0291 | C6 | .18732214 | −.58926246 |
| P12 | .17502475 | −.61563639 | | | | | |
| P13 | .21616022 | −.63481667 | R7 | .0528 | C7 | .19384741 | −.68267039 |
| P14 | .24530744 | −.69449009 | | | | | |
| P15 | .24009975 | −.71716306 | R8 | .1675 | C8 | .07685060 | −.67966686 |
| P16 | .07685060 | −.84716686 | | | | | |

What is claimed is:

1. A root for attaching a blade to a rotor in a groove having a shape substantially corresponding to a shape of the root, such that the root and groove have a common center line, the root comprising:

an uppermost neck symmetrically shaped about the center line;

an uppermost lug formed below the uppermost neck and symmetrically shaped about the center line, and having on each side of the center line a flat bearing surface $b_1$, a length of which is defined by a beginning point and a terminating point, a radiused fillet surface $s_1$ of radius R2, an arcuate length of which is defined by a terminating point coexistent with the beginning point of the bearing surface $b_1$, the bearing surface $b_1$ being in surface contact with a corresponding flat bearing surface of the groove which is defined by a beginning point and a terminating point, the terminating point being at a greater horizontal distance from the center line than the beginning point, the groove including a radiused fillet surface of radius R3, an arcuate length of which is defined by a beginning point coexistent with the terminating point of the groove bearing surface, a zone of contact between the root bearing surface $b_1$ and the groove bearing surface extending over a length $l_1$ from the beginning point of the groove bearing surface to the terminating point of the root bearing surface;

a lowermost neck formed below the uppermost lug and symmetrically shaped about the center line; and a lowermost lug formed below the lowermost neck symmetrically shaped about the center line and having on each side of the center line a flat bearing surface $b_2$ a length of which is defined by a beginning point and a terminating point, a radiused fillet surface $s_2$ of radius R6, an arcuate length of which is defined by a terminating point coexistent with the beginning point of the bearing surface $b_2$, the bearing surface $b_2$ being in surface contact with a corresponding flat bearing surface of the which is defined by a beginning point and a terminating point, the terminating point being at a greater horizontal distance from the center line than the beginning point, the groove including a radiused fillet surface of radius R7, an arcuate length of which is defined by a beginning point and a terminating point, the terminating point being coexistent with the terminating point of the groove bearing surface, a zone of contact between the root bearing surface $b_2$ and the groove bearing surface extending over a length $l_2$ from the beginning point of the groove bearing surface to the terminating point of the root bearing surface, wherein a ratio of $l_2$ to $l_1$ is about 0.76, a ratio of R3 to R2 is about 1.0, and a ratio of R7 to R6 is about 1.55.

2. A root as recited in claim 1, wherein the root has a height h, the uppermost neck and the lowermost neck have a width $w_1$ and $w_2$, respectively, a ratio of $w_2$ to $w_1$ is about 0.69, a ratio of h to $w_1$ is about 2.12, a ratio of $l_1$ to $w_1$ is about 0.13, a ratio of R2 to $w_1$ is about 0.15, and a ratio of R6 to $w_1$ is about 0.08.

3. A root as recited in claim 2, wherein h is about 0.948 inches (24.08 m.m.), $w_2$ is about 0.3095 inches (7.861 m.m.), and $w_1$ is about 0.4475 inches (11.367 m.m.).

4. A root as recited in claim FIG. 1, wherein each flat bearing surface $b_1$ and $b_2$ is angled at about 25° to a plane perpendicular to the center line.

5. A root as recited in claim 1, wherein $l_1$, $l_2$, R2, R3, R6 and R7 are defined by a coordinate-point format with X and Y axes, the Y axis corresponding to the center line and the X axis being defined as a line drawn perpendicular to the center line at a point of intersection of the center line and of two planes encompassing $l_1$ for both sides of the center line wherein the length of $R_2$ is about 0.0655 inches (1.66 mm), the length of $R_3$ is about 0.0667 inches (1.69 mm), the length of $R_6$ is about 0.0341 inches (0.866 mm), the length of $R_7$ is about 0.0528 inches (1.34 mm), the beginning point of $l_1$ is located at 0.26301227, −0.12263500, the terminating point is located at 0.31579521, −0.14724641, the length of $l_1$ is about 0.058 inches (1.47 mm), and the length of $l_2$ is about 0.44 inches (1.12 mm).

* * * * *